US009593847B1

(12) United States Patent
Zink et al.

(10) Patent No.: US 9,593,847 B1
(45) Date of Patent: Mar. 14, 2017

(54) FUEL-FLEXIBLE BURNER APPARATUS AND METHOD FOR FIRED HEATERS

(71) Applicant: ZEECO, INC., Broken Arrow, OK (US)

(72) Inventors: Darton J. Zink, Tulsa, OK (US); Rex K. Isaacs, Collinsville, OK (US); A. S. (Jamal) Jamaluddin, Sugar Land, TX (US); Charles E. Benson, Windham, NH (US); Roberto O. Pellizzari, Groton, MA (US); Cody L. Little, Coweta, OK (US); Seth A. Marty, Broken Arrow, OK (US); K. Parker Imel, Coweta, OK (US); Jonathon E. Barnes, Broken Arrow, OK (US); Chris S. Parker, Tulsa, OK (US)

(73) Assignee: ZEECO, INC., Broken Arrow, OK (US)

( * ) Notice: Subject to any disclaimer, the term of this patent is extended or adjusted under 35 U.S.C. 154(b) by 386 days.

(21) Appl. No.: 14/197,333

(22) Filed: Mar. 5, 2014

(51) Int. Cl.
*F23D 14/58* (2006.01)
*F23D 14/22* (2006.01)
(Continued)

(52) U.S. Cl.
CPC ..... *F23D 14/22* (2013.01); *F23D 14/58* (2013.01); *F23D 14/60* (2013.01); *F23D 14/62* (2013.01)

(58) Field of Classification Search
CPC ..... F23D 14/22
(Continued)

(56) References Cited

U.S. PATENT DOCUMENTS 1,234,088 A 7/1917 Ralston
2,174,663 A 10/1939 Keller
(Continued)

FOREIGN PATENT DOCUMENTS

DE 600 16 106 12/2005
EP 0967440 A2 12/1999
(Continued)

OTHER PUBLICATIONS

Extended European Search Report; European Patent Office; Jul. 6, 2015; Europe.
(Continued)

*Primary Examiner* — Avinash Savani
(74) *Attorney, Agent, or Firm* — Dennis D. Brown; Brown Patent Law, P.L.L.C.

(57) ABSTRACT

A burner apparatus for a fired heating system and a method of burner operation. The burner provides stable operation when burning gas fuels having heating values ranging from low to high and accommodates sudden wide changes in the Wobbe value of the fuel delivered to the burner. The burner apparatus includes a plurality of exterior fuel ejectors and has an exterior notch which extends around the burner wall for receiving and combusting a portion of the gas fuel. At least a portion of the hot combustion product gas produced in the exterior notch is delivered through channels formed in the burner wall to the combustion area at the forward end of the burner. As the Wobbe value of the gas fuel decreases, one or more outer series of addition ejectors can be automatically activated as needed to maintain the amount of heat output desired.

19 Claims, 5 Drawing Sheets

(51) Int. Cl.
*F23D 14/60* (2006.01)
*F23D 14/62* (2006.01)

(58) Field of Classification Search
USPC ..... 431/12, 176
See application file for complete search history.

(56) References Cited

U.S. PATENT DOCUMENTS

| | | | | |
|---|---|---|---|---|
| 2,643,916 | A | 6/1953 | White et al. | |
| 2,671,507 | A | 3/1954 | Morck | |
| 2,808,876 | A | 10/1957 | Loof | |
| 2,851,093 | A | 9/1958 | Zink et al. | |
| 2,918,117 | A | 12/1959 | Griffin | |
| 3,000,435 | A | 9/1961 | Bloom et al. | |
| 3,033,273 | A | 5/1962 | Zink, Jr. et al. | |
| 3,180,395 | A | 4/1965 | Reed | |
| 3,198,436 | A | 8/1965 | Kurzinski et al. | |
| 3,217,779 | A | 11/1965 | Reed et al. | |
| 3,639,095 | A | 2/1972 | Zink et al. | |
| 3,644,076 | A | 2/1972 | Bagge | |
| 3,672,655 | A | 6/1972 | Carter | |
| 3,737,105 | A | 6/1973 | Arnold et al. | |
| 3,771,944 | A | 11/1973 | Hovis et al. | |
| 3,798,948 | A | 3/1974 | Fangmeier et al. | |
| 3,876,362 | A | 4/1975 | Hirose | |
| 3,915,621 | A | 10/1975 | Iverson | |
| 3,924,574 | A | 12/1975 | Ebeling | |
| 3,929,511 | A | 12/1975 | Solomon | |
| 3,954,382 | A | 5/1976 | Hirose | |
| 4,004,875 | A | 1/1977 | Zink et al. | |
| 4,009,989 | A | 3/1977 | Bitterlich | |
| 4,014,654 | A | 3/1977 | Howell | |
| 4,162,140 | A | 7/1979 | Reed | |
| 4,231,735 | A | 11/1980 | Downs | |
| 4,237,858 | A | 12/1980 | Goodnight et al. | |
| 4,257,762 | A | 3/1981 | Zink et al. | |
| 4,257,763 | A | 3/1981 | Reed | |
| 4,277,942 | A | 7/1981 | Egnell et al. | |
| 4,289,474 | A | 9/1981 | Honda et al. | |
| 4,395,223 | A | 7/1983 | Okigami et al. | |
| 4,412,808 | A | 11/1983 | Sheppard et al. | |
| 4,428,727 | A | 1/1984 | Deussner et al. | |
| 4,451,230 | A | 5/1984 | Bocci et al. | |
| 4,476,791 | A | 10/1984 | Cegielski, Jr. | |
| 4,483,832 | A | 11/1984 | Schirmer | |
| 4,496,306 | A | 1/1985 | Okigami et al. | |
| 4,505,666 | A | 3/1985 | Martin et al. | |
| 4,575,332 | A | 3/1986 | Oppenberg et al. | |
| 4,702,691 | A | 10/1987 | Ogden | |
| 4,708,638 | A | 11/1987 | Brazier et al. | |
| 4,756,684 | A | 7/1988 | Nishikawa et al. | |
| 4,945,841 | A | 8/1990 | Nakamachi et al. | |
| 5,044,932 | A | 9/1991 | Martin et al. | |
| 5,073,105 | A | 12/1991 | Martin et al. | |
| 5,098,282 | A | 3/1992 | Schwartz et al. | |
| 5,118,284 | A | 6/1992 | Mutchler | |
| 5,138,860 | A | 8/1992 | Del Fabro et al. | |
| 5,154,596 | A | 10/1992 | Schwartz et al. | |
| 5,180,300 | A | 1/1993 | Hovis et al. | |
| 5,195,884 | A | 3/1993 | Schwartz et al. | |
| 5,238,395 | A | 8/1993 | Schwartz et al. | |
| 5,269,678 | A | 12/1993 | Schwartz et al. | |
| 5,271,729 | A | 12/1993 | Gensler et al. | |
| 5,284,438 | A | 2/1994 | McGill et al. | |
| 5,302,113 | A | 4/1994 | Eichelberger et al. | |
| 5,344,307 | A | 9/1994 | Schwartz et al. | |
| 5,441,404 | A | 8/1995 | Christenson | |
| 5,458,481 | A | 10/1995 | Surbey et al. | |
| 5,542,840 | A | 8/1996 | Surbey et al. | |
| 5,545,031 | A | 8/1996 | Joshi et al. | |
| 5,554,022 | A | 9/1996 | Nabors, Jr. et al. | |
| 5,562,437 | A * | 10/1996 | Gauthier | F23C 6/045 431/10 |
| 5,575,637 | A | 11/1996 | Slavejkov et al. | |
| 5,611,682 | A | 3/1997 | Slavejkov et al. | |
| 5,632,614 | A | 5/1997 | Consadori et al. | |
| 5,676,010 | A | 10/1997 | College et al. | |
| 5,680,823 | A | 10/1997 | LaRose | |
| 5,688,115 | A | 11/1997 | Johnson | |
| 5,709,541 | A | 1/1998 | Gensler et al. | |
| 5,797,738 | A * | 8/1998 | Wills | F23C 6/045 431/10 |
| 5,816,466 | A | 10/1998 | Seufer | |
| 5,957,678 | A | 9/1999 | Endoh et al. | |
| 5,975,886 | A | 11/1999 | Philippe | |
| 5,980,243 | A | 11/1999 | Surbey et al. | |
| 6,007,325 | A | 12/1999 | Loftus et al. | |
| 6,045,353 | A | 4/2000 | VonDrasek et al. | |
| 6,067,835 | A | 5/2000 | Pollock | |
| 6,499,990 | B1 | 12/2002 | Zink et al. | |
| 6,536,950 | B1 | 3/2003 | Green et al. | |
| 6,626,661 | B1 | 9/2003 | Zink | |
| 6,672,858 | B1 | 1/2004 | Benson et al. | |
| 6,695,609 | B1 | 2/2004 | Chung et al. | |
| 6,875,008 | B1 | 4/2005 | Martin et al. | |
| 7,383,973 | B2 | 6/2008 | Enyedy | |
| 7,441,682 | B2 | 10/2008 | Kerekes et al. | |
| 7,670,135 | B1 | 3/2010 | Zink | |
| 7,777,977 | B2 | 8/2010 | Chase et al. | |
| 7,907,272 | B2 | 3/2011 | Zelepouga et al. | |
| 8,138,927 | B2 | 3/2012 | Diepenbroek et al. | |
| 8,274,560 | B2 | 9/2012 | Galfrascoli et al. | |
| 2001/0018171 | A1 | 8/2001 | Al-Halbouni | |
| 2001/0034001 | A1 | 10/2001 | Poe et al. | |
| 2003/0148236 | A1 | 8/2003 | Joshi et al. | |
| 2004/0050131 | A1 | 3/2004 | Militaru et al. | |
| 2005/0239005 | A1 | 10/2005 | Lugnet et al. | |
| 2005/0266363 | A1 | 12/2005 | Ganeshan | |
| 2007/0266634 | A1 | 11/2007 | Tsangaris et al. | |
| 2007/0289216 | A1 | 12/2007 | Tsangaris et al. | |
| 2008/0096146 | A1 * | 4/2008 | Li | F23C 6/045 431/9 |
| 2008/0199554 | A1 | 8/2008 | Manda et al. | |
| 2008/0233523 | A1 | 9/2008 | Diepenbroek et al. | |
| 2013/0122440 | A1 | 5/2013 | Zink et al. | |

FOREIGN PATENT DOCUMENTS

| | | | |
|---|---|---|---|
| JP | 2001030077 | A | 2/2001 |
| JP | 2001205335 | | 7/2001 |
| JP | 2003266149 | A | 9/2003 |
| JP | 2008110359 | A | 5/2008 |
| WO | WO 9004740 | | 5/1990 |
| WO | WO 9850191 | | 11/1998 |
| WO | WO2014127306 | | 8/2014 |

OTHER PUBLICATIONS

Boston Gear, "Printout re 700 Series Single Reduction Flanged Reducer Dimensions", Publisher: Internet Printout, Published in : US.

Unknown, Advanced Rupture Disk Technology, Inc. "Gas Pilots", Apr. 20, 2010, Publisher: Internet Printout, Published in: US.

Bellovich, et al., "Flare Pilot System Safety", Mar. 2007, pp. 1014, vol. 26, No. 1, Publisher: American Institute of Chemical Engineers, 2006 Spring National Meeting, Orlando, FL, Published in: US.

John Zink.com, "Pilot Monitoring Systems", Apr. 20, 2010, Publisher: Internet Printout, Published in: US.

John Zink.com, "Retractable Systems", Apr. 20, 2010, Publisher: Internet Printout, Published in: US.

John Zink.com, "Retractable Therocouples", Apr. 20, 2010, Publisher: Internet Printout, Published in: US.

Zeeco, Inc., "Auxiliary Equipment Pilot Monitors", Apr. 20, 2010, Publisher: Internet Printout, Published in: US.

Jamaluddin, et al, "Development and Testing of a Fuel-Flexible Burner for Fired Heaters"; Published in: US.

Jamaluddin, et al., "Development of a Fuel-Flexible Burner for Process Plants"; American Flame Research Committee Annual Meeting; Salt Lake City, Utah; Sep. 5-7, 2012.

Vandermeer, Willy; "Flame Safeguard Controls in Multi-Burner Environments"; Apr. 1998; Published in: US.

(56) References Cited

OTHER PUBLICATIONS

Borg, Stephen et al; "A Fiber-Optic Probe Design for Combustion Chamber Flame Detection Applications"; NASA/TM-2001-211233; Oct. 2001; Published in: US.
U.S. Appl. No. 13/789,004; "Apparatus and Method for Monitoring Flares and Flare Pilots"; First Named Inventor: Cody L. Little; filed Mar. 7, 2013.
U.S. Appl. No. 13/935,152; "Apparatus for Installing a Retractable Thermocouple"; First Named Inventor: Clayton A. Francis; filed Jul. 3, 2013.
U.S. Appl. No. 14/229,820; "Non-Symmetrical Low NOx Burner Apparatus and Method"; First Named Inventor: Darton J. Zink; filed Jun. 9, 2014.

* cited by examiner

FUEL-FLEXIBLE BURNER APPARATUS AND METHOD FOR FIRED HEATERS

This invention was made with government support under Contract No. DE-EE0000069 awarded by the United States Department of Energy. The government has certain rights in the invention.

FIELD OF THE INVENTION

The present invention relates to burner apparatuses and methods used in process heaters, boilers, incinerators, and other fired heating systems.

BACKGROUND OF THE INVENTION

A need exists for a fuel-flexible burner for refineries, chemical plants, and other facilities which will enable the operation of fired heaters using fuels ranging from conventional gases to bio-gases and synthetic gases. The burner will preferably be effective for safely and efficiently burning a broad range of gaseous fuels in a cost-effective manner while also minimizing emissions of pollutants. In addition, the burner will preferably provide a flame stabilization mechanism which will allow the burner and the fired heating system to quickly and safely adapt to sudden and wide swings in the heating value of the fuel delivered to the burner.

In a petroleum refinery, the composition of the refinery fuel gas generated by the refinery operations will vary considerably, and can change suddenly, depending upon the refinery configuration and upon the operating status and characteristics of the numerous processing units within the refinery. For example, Flexicoker off-gas is a low-BTU gas which is produced and used in many refineries and which can significantly reduce the heating value of the fuel delivered to the burner if used separately or in combination with other gases.

Heretofore, when the heating value or supply of the refinery fuel gas has been low, natural gas has typically been blended with the refinery-generated gases to supply the balance of the plant's energy requirements. Alternatively, natural gas can serve as a dedicated fuel for a unit or an entire plant.

Additional gaseous fuels of interest for use in fired-heaters include biogas from organic matter digesters, including animal and agricultural wastes, waste water plants, and landfills; as well as syngases from the gasification of biomass, municipal solid wastes, construction wastes, or refinery residuals such as tar, pitch and petroleum coke. Unfortunately, however, these gases typically have very low heating values and can vary significantly in composition.

The degree of interchangeability of gaseous fuels for use in combustion applications can be evaluated by determining and comparing the Wobbe numbers of the fuels in question. The Wobbe number of a gaseous fuel is determined by dividing the higher heating value of the fuel by the square root of its specific gravity. For incompressible flow through a fixed fuel orifice with constant fuel supply pressure, the energy flow rate (i.e., firing rate) of a gas fuel will be proportional to its Wobbe number.

Typically, the Wobbe number values for the different types of gas fuels mentioned above are as follows: from 120 to 150 for syngas; from 500 to 600 for biogas; from 1300 to 1400 for natural gas; and from 1100 to 1500 for refinery fuel gas. Consequently, in order to be able to use all of these various types of fuels interchangeably in one combustion system, the combustion system would be required to accommodate over an order of magnitude of variation in the Wobbe number value of the fuel delivered to the burner.

Heretofore, the burners available in the art have not been able to adequately and effectively respond and adapt to heating value and Wobbe number value changes approaching this magnitude. In fact, most commercial burners currently in service are not capable of handling low heating value fuels such as biogas and syngas at all. The stability mechanisms of the burners currently available in the market are typically designed for fuels that burn much more readily. Moreover, rapidly changing from one fuel to another stresses the stability of the burner even further.

Consequently, biogases, syngases, and other such low heating value gases are commonly viewed as being essentially unusable and as being so difficult to burn in a stabilized manner that they are simply flared off, thus wasting the energy content of these gases and leading to an increase in greenhouse gas emissions.

SUMMARY OF THE INVENTION

The present invention provides a fuel-flexible burner apparatus, and a method of burner operation, which satisfy the needs and alleviate the problems discussed above. The inventive burner and method allow the interchangeable use of fuels having Wobbe number values ranging from 1800 or more (e.g., high heating value conventional gas fuels) to 100 or less (e.g., low heating value bio-gases and synthetic gases). The unique flame stabilization features provided by the inventive burner and method also allow the burner to safely accommodate sudden and wide swings in the heating value of the fuel delivered to the burner, without exhibiting noticeable changes in the stability of the burner flame.

In addition, the inventive fuel-flexible burner and method generate very low levels of $NO_x$ and CO emissions. Further, by allowing the beneficial use of bio-gases, syngas, and other minimal heating value gases which have typically heretofore simply been disposed of by flaring, the inventive fuel-flexible burner and method operate to: reduce greenhouse gas emissions; reduce plant energy costs; reduce $NO_x$ emissions; and mitigate, to some degree, increases in the price of natural gas.

In one aspect, there is provided a burner apparatus for a fired heating system. The burner apparatus preferably comprises: (a) a longitudinally extending burner wall, the burner wall having a forward end, a longitudinally extending exterior, a longitudinally extending air passageway which extends through and is substantially surrounded by the burner wall, and a discharge opening of the air passageway at the forward end of the burner wall; (b) an exterior notch which is provided in and extends substantially around the longitudinally extending exterior of the burner wall, wherein the exterior notch is positioned rearwardly of the forward end of the burner wall; (c) a plurality of primary air delivery channels which are formed in the burner wall and extend to the exterior notch; (d) a plurality of primary combustion product gas discharge channels which extend in the burner wall from the exterior notch to the forward end of said burner wall; and (e) a plurality of fuel ejection structures positioned outside of the burner wall wherein the fuel ejection structures have fuel ejection ports and at least some of the fuel ejection ports are oriented for delivering at least a portion of the gas fuel into the exterior notch.

In another aspect, there is provided a method of operating a burner comprising the steps of: (a) ejecting a gas fuel from a plurality of ejection structures positioned outside of a longitudinally extending burner wall such that a first portion of the gas fuel is received in an exterior notch which is provided in and extends around a longitudinally extending exterior of the burner wall, the exterior notch being positioned rearwardly of a forward end of the burner wall; (b) delivering a first amount of air into the exterior notch and combusting at least some of the first portion of the gas fuel in the exterior notch to produce a primary combustion product gas; (c) delivering at least a portion of the primary combustion product gas to the forward end of the burner wall via a plurality of primary combustion product discharge channels which extend in the burner wall from the exterior notch to the forward end of the burner wall; and (d) combusting a second portion of the gas fuel forwardly of the exterior notch with air delivered through an air passageway which extends longitudinally through and is surrounded by the burner wall.

Further objects, features, and advantages of the present invention will be apparent to those of ordinary skill in the art upon reviewing the accompanying drawings and upon reading the following Detailed Description of the Preferred Embodiments.

DETAILED DESCRIPTION OF THE PREFERRED EMBODIMENTS

Figure 1:
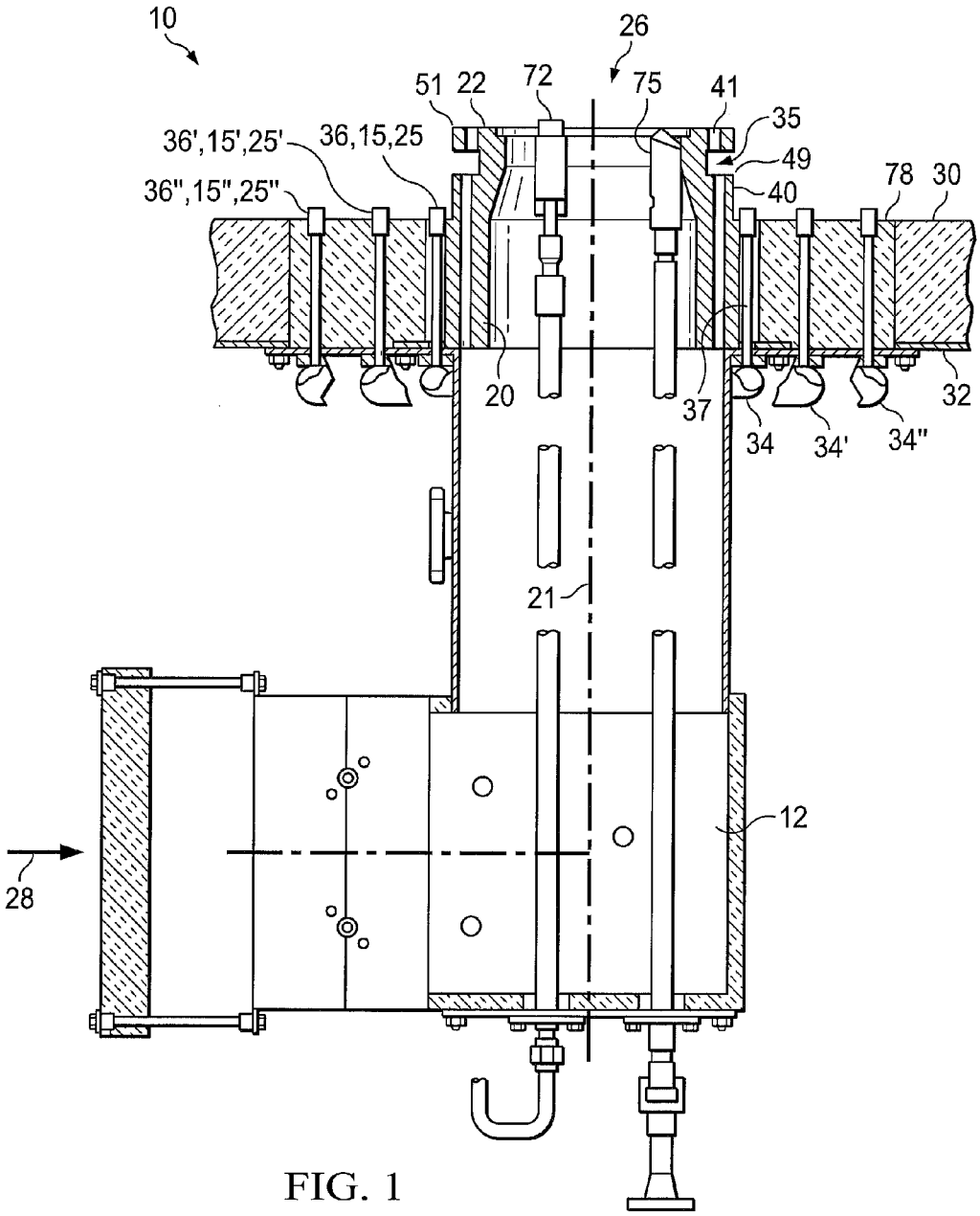
FIG. 1 is a cutaway elevational view of an embodiment 10 of the inventive burner assembly.
Figure 2:
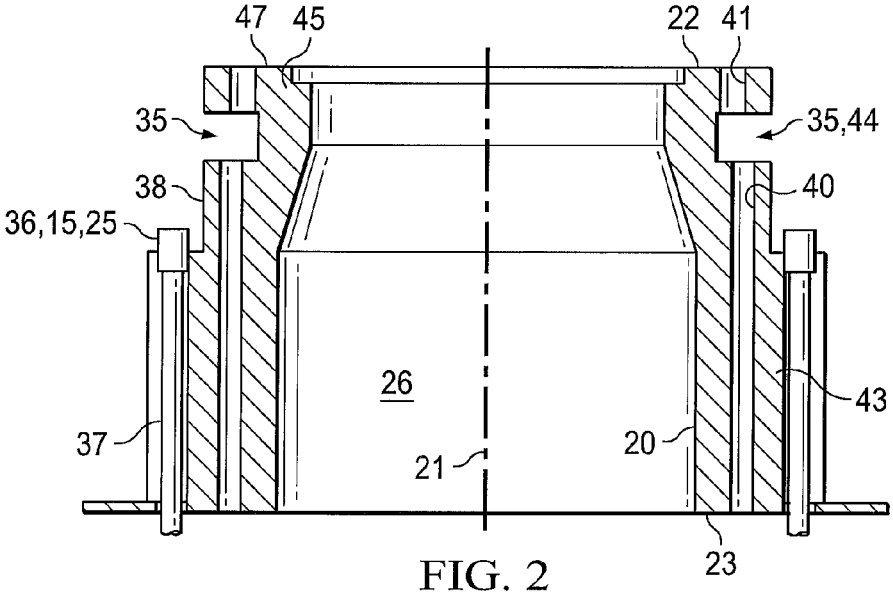
FIG. 2 is a cutaway elevational view of an embodiment 20 of the burner wall of the inventive burner assembly 10.
Figure 3:
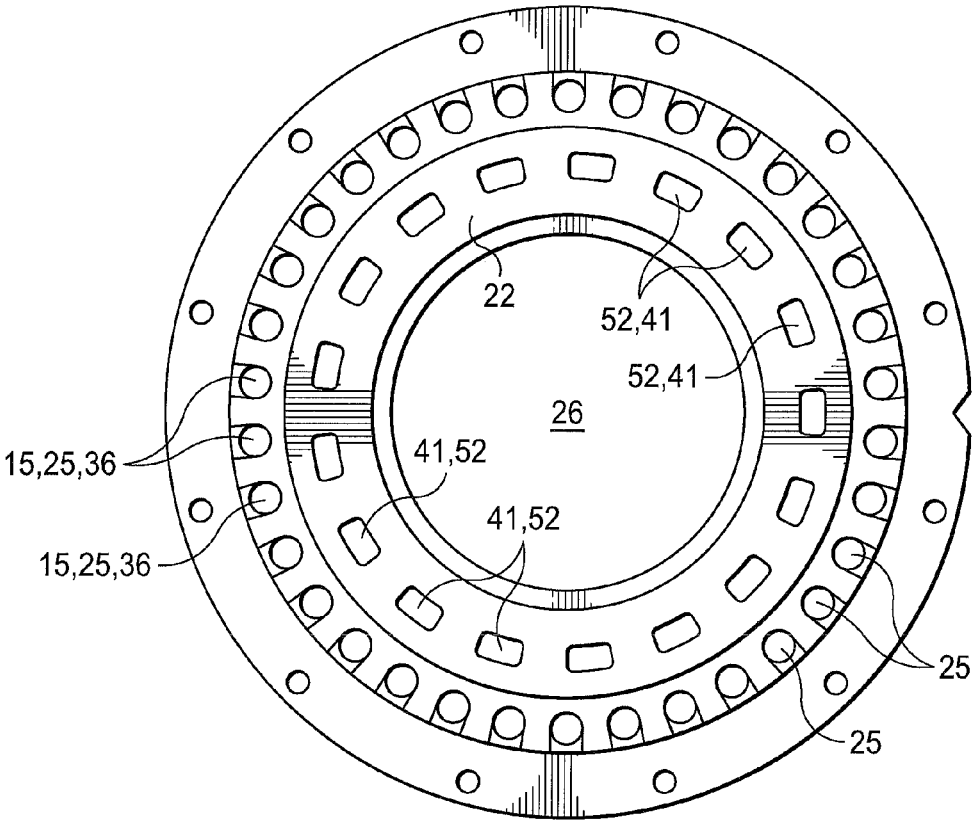
FIG. 3 is a plan view of the inventive burner wall 20.
Figure 4:
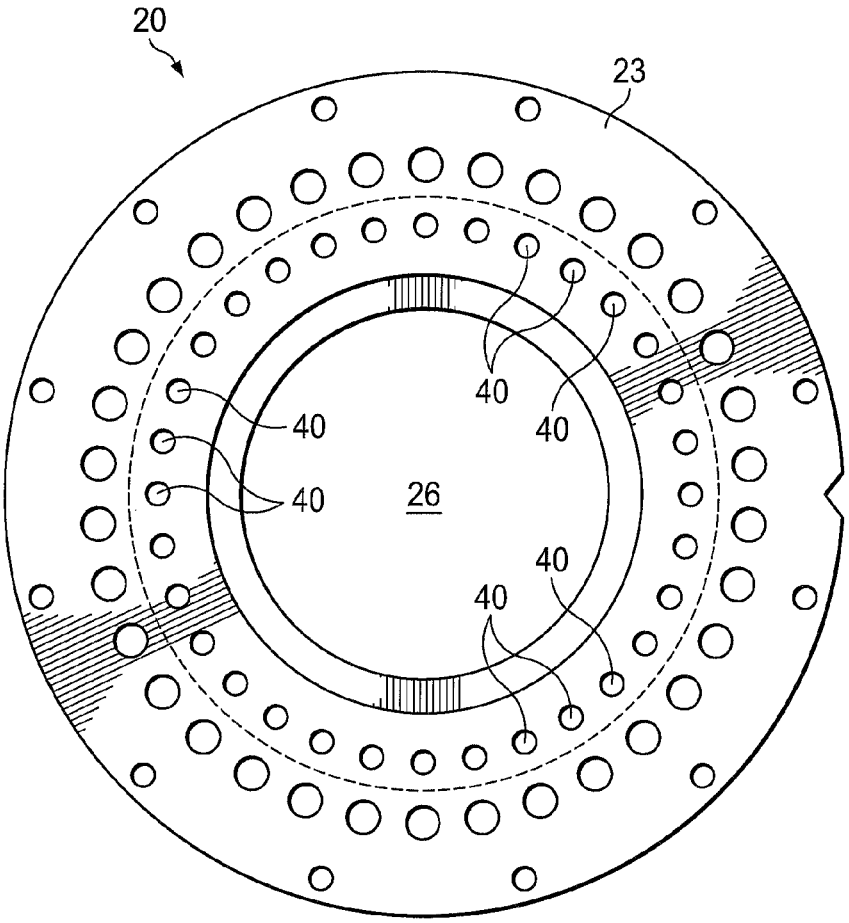
FIG. 4 is a bottom view of the burner wall 20.
Figure 5:
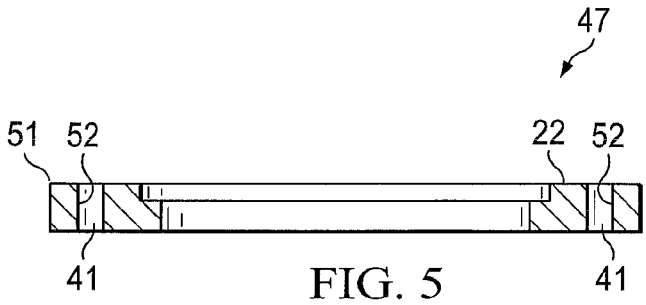
FIG. 5 is a cutaway elevational view of a forward tile end piece 47 of the burner wall 20.
Figure 6:
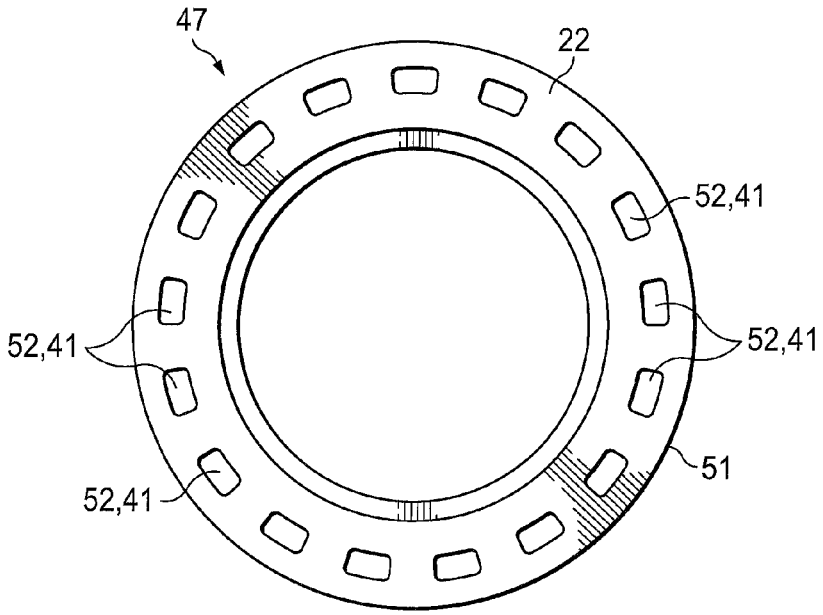
FIG. 6 is a plan view of the tile end piece 47.
Figure 7:
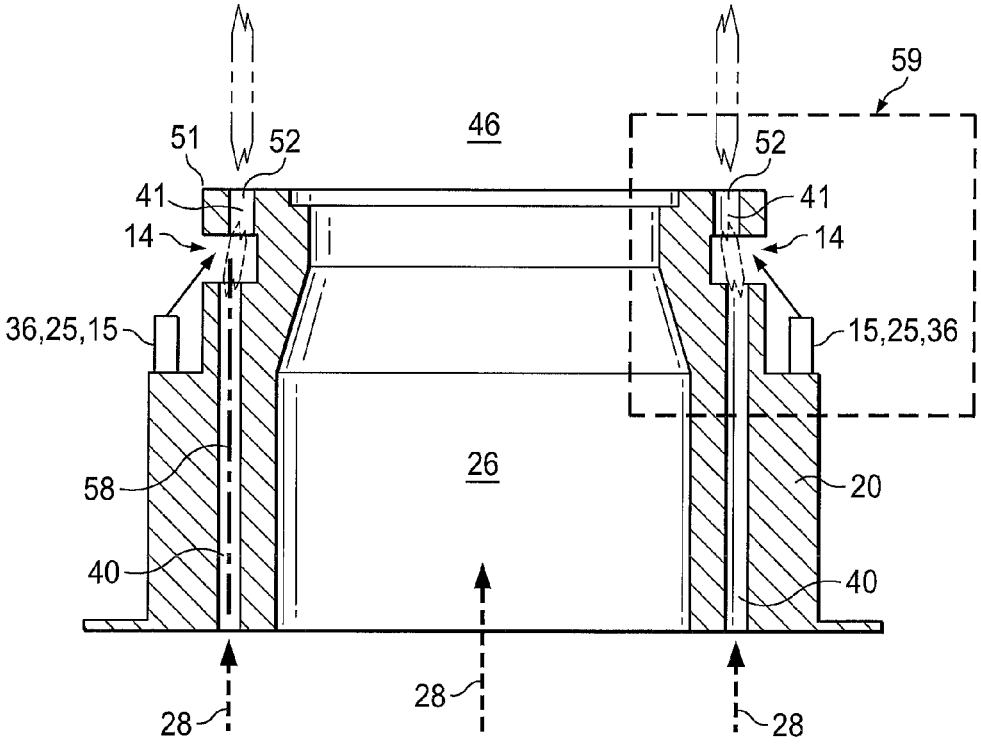
FIG. 7 is a schematic cutaway elevational view of the burner wall 20.
Figure 8:
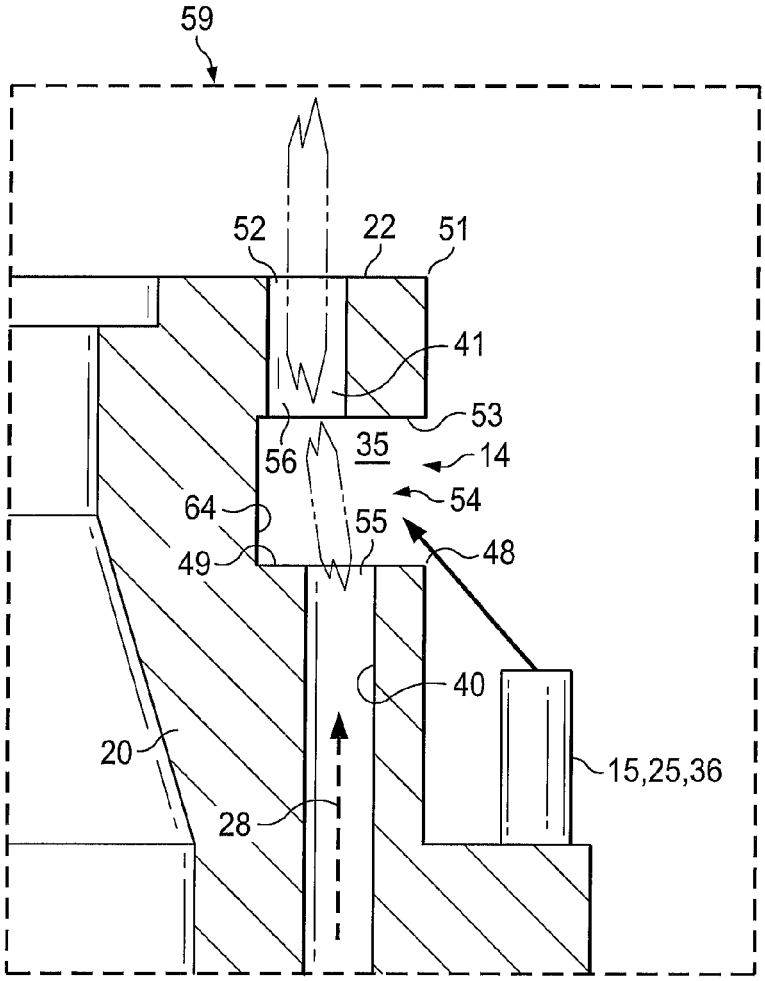
FIG. 8 is an enlarged schematic cutaway view of the portion 59 of the burner wall 20 identified in FIG. 7.

In the inventive burner apparatus and method of operation, an initial (primary) combustion and flame stabilization zone is created by combusting a portion of the burner fuel in an annular exterior notch which is formed in and around, or at least substantially around, the exterior of the burner tile wall. The annular exterior notch is positioned rearwardly of the forward end of the burner and is preferably configured and sized to receive less than 20%, more preferably from about 2% to about 15% and most preferably from about 5% to about 10%, of the total fuel and air combusted by the burner. The hot combustion products produced in this primary zone are channeled to the forward end of the burner wall where they mix with and provide an ignition source for the main fuel and air streams in a secondary combustion and stabilization zone, thereby further enhancing the ignition and stabilization of the main flame of the burner at or near the forward end of the burner wall.

By way of example, an embodiment 10 of the inventive burner apparatus is illustrated in FIGS. 1-8. The inventive burner 10 comprises a housing 12 and a burner wall 20. The burner wall 20 has: a longitudinal axis 21, an outlet or forward end 22, a base end 23, and a central passageway or throat 26 extending therethrough. The burner wall 20 is preferably constructed of a high temperature refractory burner tile material.

The outlet end 22 of burner 10 is in communication with the interior of the fired heater, boiler, incinerator, or other fired heating system enclosure in which combustion takes place and which therefore contains combustion product gases (i.e., flue gas). Burner 10 is shown as installed through a furnace floor or other wall 32, typically formed of metal. Insulating material 30 will typically be secured to the interior of furnace wall 32.

Combustion air or other oxygen-containing gas 28 is received in housing 12 and directed thereby into the inlet end 23 of burner throat 26. The air 28 exits the burner at the outlet end 22 thereof. As will be understood, the quantity of combustion air entering housing 12 can be regulated, for example, by a combustion air inlet damper. The air 28 can be provided to housing 12 as necessary by forced circulation, induced draft, balanced draft, natural draft, or in any other manner employed in the art.

A burner pilot 72 will preferably be located within the central passageway 26 of the burner wall 20 for initiating combustion at the outer end 22 of the burner. As will be understood by those in the art, the burner assembly 10 can also include one or a plurality of auxiliary pilots 75. Alternatively or in addition, the annular exterior notch 35 (described below) of the inventive burner 10 can be used as a pilot by feeding natural gas to the notch 35 via one or more of the air delivery channels 40 (described below) of the inventive burner 10 and providing a spark or hot surface igniter to light off a segment of the annular exterior notch 35.

The burner wall 20 of inventive burner 10 can be circular, square, rectangular, or generally any other desired geometry. The burner wall 20 will preferably have a circular or substantially circular cross-sectional shape.

The burner wall 20 of the inventive burner apparatus 10 preferably comprises: an annular exterior notch 35 as mentioned above which is provided in, and surrounds or at least substantially surrounds, the longitudinally extending exterior 38 of the burner wall 20; a plurality of primary air delivery channels 40 which are formed within and extend longitudinally through the burner wall 20 from the base end 23 of the burner wall 20 to the annular exterior notch 35; and a plurality of primary combustion product gas discharge channels 41 which are formed within and extend longitudinally through the burner wall 20 from the annular exterior notch 35 to the outer (forward) end 22 of the burner wall 20.

In the inventive burner apparatus 10, a portion of the gas fuel (preferably less than 20% of the total gas fuel) is combusted in and typically also to some degree outside of, the annular exterior notch 35 to provide an initial (primary) combustion and flame stabilization zone 14. The main combustion zone 46 of the inventive burner 10, however, is located forwardly of the annular exterior notch 35 and preferably begins at or close to the forward end 22 of the burner wall 20.

The burner wall 20 can be formed of either a single piece of refractory tile or a plurality of assembled pieces. The burner wall 20 is preferably formed of two pieces which comprise: (a) a longitudinally extending base tile piece 43 having a groove 44 formed around its distal end 45 and (b) a forward tile end piece 47 which is attached to the distal end 45 of the base tile piece 43 using mortar or any other suitable material or attachment means. The attachment of the tile end piece 47 to the distal end 45 of the base piece 43 closes the forward end of distal groove 44 of the base piece 43 so that the distal groove 44 of the base piece 43 forms the annular exterior notch 35 in the assembled burner wall structure. In addition, this two piece embodiment allows the primary combustion product gas discharge channels 41 to be conveniently formed in the tile end piece 47 prior to assembly, and also allows the primary air delivery channels to be separately formed prior to assembly in the base piece 43.

A series 15 of primary ejection tips, nozzles, or other primary fuel gas ejector structures 25 preferably at least substantially surrounds, and most preferably entirely surrounds, the burner wall 20. The primary fuel ejectors 25 are preferably positioned longitudinally rearward of and laterally outward from the annular exterior notch 35.

In embodiment 10 of the inventive burner, each primary ejector 25 is depicted as comprising a primary fuel ejection tip 36 secured over the end of a fuel pipe 37. Each fuel pipe 37 is in communication with a primary fuel supply manifold 34 and can, for example, either (a) extend through a lower outer skirt portion of the burner tile 20, (b) be affixed within the insulating material 30 attached to furnace wall 32, or (c) extend through an insulation filler material (e.g., a soft, high temperature insulating blanket material 78) installed between the lower end of the burner tile 20 and the furnace wall insulating material 30. While the fuel pipes 37 are preferably connected to a primary fuel supply manifold 34, it will be understood that any other type of fuel supply system can alternatively be used in the present invention.

The flow nozzles of at least some of the ejectors 25 of the primary series of ejectors 15 are oriented for discharging at least a portion of the gas fuel in a free jet flow regime toward and into the annular exterior notch 35. Preferably, a first set of the ejectors 25 in the primary series 15 are oriented to deliver a portion of the gas fuel into the annual exterior notch 35 and a second set (i.e., the remainder) of the primary ejectors 25 are oriented to deliver a portion of the gas fuel forwardly of the annular exterior notch 35.

More preferably, the first set of primary ejectors 25 are oriented to deliver a portion of the gas fuel toward the outer edge 48 of the rearward lateral wall 49 of the exterior notch 35 and the second set of primary ejectors are oriented to deliver a portion of the gas fuel toward the outer edge 51 of the forward end 22 of the burner wall 20. In this scenario, the rearward outer edge 48 of the exterior notch 35 and the forward outer edge 51 at the end 22 of the burner wall 20 operate as impact structures which decrease the flow momentum and/or increase the turbulence of the gas fuel streams sufficiently to promote flue gas entrainment and mixing while still allowing the respective streams to flow on to the primary (initial) and secondary (main) combustion zones 14 and 46. The hot, low-pressure areas created by contacting the refractory edges 48 and 51 further contribute to the enhanced combustion and flame stability provided by the inventive burner 10.

In one preferred arrangement, the first set of ejectors 25 in the primary series 15 (i.e., the primary ejectors which are directed toward the exterior notch 35) are arranged in an alternating relationship with the remaining second set of primary ejectors 25 such that (a) a first primary ejector 25 will eject gas fuel into the exterior notch 35, (b) the next succeeding primary ejector 25 will eject gas fuel forwardly of the exterior notch 35, (c) the next succeeding primary ejector 25 will eject gas fuel into the exterior notch 35, (d) etc. In other words, in this embodiment, every other tip 25 in the primary series 15 is oriented to eject gas fuel into the annular exterior notch 35.

Given that preferably less than 20% (more preferably about 2% to about 15% and most preferably about 5% to about 10%) of the total gas fuel used in the burner 10 is delivered to the annular exterior notch 35 of the burner 10, the flow orifices of the first set of ejectors 25 in the primary series 15 are sized to collectively deliver this amount of gas fuel to the notch 35 at a free jet velocity. The orifices of all of the other ejectors used in the inventive burner apparatus 10, on the other hand, are preferably sized to collectively deliver the remainder of the gas fuel to one or more locations beyond the annular exterior notch 35.

Consequently, by way of example, but not by way of limitation, if the primary series 15 of ejectors 25 is the only series of ejectors included in the inventive burner 10 and the primary ejectors 25 are arranged in an alternating relationship so that roughly half of the primary ejectors were oriented to eject gas fuel into the exterior notch 35, then the flow orifices of the other half of the primary ejectors 25 will be size to collectively discharge at least 80%, more preferably from about 85% to about 98% and most preferably from about 90% to about 95%, of the total gas fuel.

The number and size of the primary air delivery channels 40 extending longitudinally inside the burner wall 20 to the annular exterior notch 35 will preferably be sufficient to deliver the amount of combustion air needed to obtain a desired air/fuel combustion ratio in the primary combustion zone 14. This amount of air will typically be less than 20%, more preferably from about 2% to about 15% and most preferably from about 5% to about 10%, of the total combustion air used in the burner 10.

The primary air delivery channels 40 will preferably be arranged in a continuous series within the burner wall 20. In addition, the number of primary air delivery channels 40 will preferably be the same as the number of ejectors 25 in the primary series 15 of ejectors surrounding the burner wall. More preferably, a primary air delivery channel 40 will be positioned adjacent to each of the primary ejectors 25 surrounding the burner wall 20. Further, the diameter or width of the primary air delivery channels 40 will preferably be less than 50%, more preferably less than 33%, of the lateral width of the annular external notch 35.

Similar to the air delivery channels 40, the primary combustion product gas discharge channels 41 will also preferably be arranged in a continuous series within the outer portion of the burner wall 20. The combustion product discharge channels 41 will preferably be sized to allow the combustion product gases produced in the annular exterior notch 35 to flow through the combustion product discharge channels 41 to the outlet end 22 of the burner wall 20. In order to provide enhanced stabilization for the main flame of the burner 10, the cross-sectional shape, orientation, and location of the primary combustion product discharge channels 41 will preferably be selected to increase the size and strength of the recirculation zones established at the discharge openings 52 of the channels 41 at the outlet end 22 of the burner wall 20.

The primary combustion product discharge channels 41 are preferably rectangular, but could be circular other desired shapes. In addition, the discharge openings 52 of the primary combustion product discharge channels 41 preferably surround or substantially surround the outer discharge opening of the central air passageway 26 of the burner wall 20 and also preferably provide a total combined open length or arc length which is from about 30% to about 70%, more preferably from about 40% to about 60% and most preferably about 50% of the total distance around (e.g., the circumference of, in the case of a round burner) the outer end 22 of the burner wall 20.

Although other cross-sectional shapes can alternatively be used, the annular exterior notch 35 provided around the burner wall 20 preferably has a square or other rectangular longitudinal cross-sectional shape which is bound by three refractory surfaces, i.e., the rearward lateral internal wall 49 of the of the exterior notch 35, a forward lateral internal wall 53, and longitudinal interior wall 64. Except for the air delivery and combustion product discharge channels 40 and 41, the only open area of the annular exterior notch 35 is its longitudinally extending outer face 54 which receives radiation from the furnace chamber. Consequently, the net heat loss from the primary combustion zone 14 is very low, thus further increasing the stability of the primary combustion zone 14. In addition, a portion of the hot combustion gas product produced in the exterior notch 35 can exit the notch 35 via its open outer face 54 to provide a further ignition source for the forward outer edge 51 of the burner wall 20.

Further, the geometry of the annular exterior notch 35, the manner of delivery of the fuel stream through the open outer face 54 of the notch 35, the internal location of the discharge openings 55 of the primary air delivery channels 40, and the internal location of the inlet openings 56 of the primary combustion gas discharge channels 41 operate together to create and drive a toroidal circulation zone within the annular exterior notch 35. The resulting circulation and mixture of the fuel, air, and hot combustion products within the toroid serve to ignite the incoming fuel and to provide sufficient residence time for combustion to occur, thus further increasing the stability of the primary combustion and stabilization zone 14.

In regard to the internal cross-sectional geometry of the annular exterior notch 35, the internal discharge openings 55 of the primary air delivery channels 40 are preferably positioned such that the longitudinally extending center lines of the air delivery channels 40 are laterally outside of the longitudinally extending centerline 58 of the annular exterior combustion notch 35. This positioning allows the air stream to drive the toroidal circulation in the desired direction. In addition, to further drive the circulation and to prevent the primary air streams from passing straight through the annular combustion notch 35, the series of internal inlet openings 56 of the primary combustion product gas discharge channels 41 is preferably offset laterally inward from the series of internal air delivery openings 55. In addition, the longitudinally extending centerlines of the primary combustion gas discharge channels 41 are preferably positioned laterally inside of the longitudinally extending centerline 58 of the annular exterior notch 35. Also, to further promote strong circulation within the annular exterior notch 35, the notch 35 will preferably have a cross-sectional aspect ratio (longitudinal width/lateral depth) of from about 0.9 to about 1.5.

To provide further flexibility for burning low heating value fuel and for responding to sudden rapid swings in the Wobbe number value of the incoming fuel, the inventive burner 10 preferably also includes a series 15' of secondary ejection tips, nozzles, or other fuel ejectors 25' which preferably at least substantially surrounds, and more preferably entirely surrounds, and is spaced radially outward from, the series 15 of primary ejectors 25. The secondary fuel ejectors 25' are preferably positioned longitudinally rearward of and laterally outward from the forward end 22 of the burner wall 20.

Each secondary ejector 25' preferably comprises a secondary fuel ejection tip 36' secured over the end of a fuel supply pipe which is connected to a secondary fuel supply manifold 34'. Although secondary fuel pipes for the secondary ejector tips 36' are preferably connected to a secondary fuel supply manifold 34', it will be understood that any other type of fuel supply system could alternatively be used for the secondary ejectors 25'.

The series 15' of secondary ejection tips, nozzles, or other secondary fuel ejection structures 25' will preferably be spaced radially outward from the series 15 of primary fuel gas ejection structures 25 by a distance of at least about 0.5 inches. Although greater spacings can be used for larger burners, it will typically be preferred that the series 15' of secondary fuel ejectors 25' be spaced radially outward from the series 15 of primary fuel ejectors 25 by a distance in the range of from about 1.5 to about 7.5 inches, most preferably from about 2 to about 4.5 inches.

The inventive burner 10 illustrated in FIG. 1 also additionally includes an optional third series 15" of ejection tips, nozzles, or other fuel ejection structures 25" which preferably substantially surrounds, and more preferably entirely surrounds, and is spaced radially outward from, the series 15' of secondary ejectors 25'. The ejectors 25" are preferably positioned longitudinally rearward of and laterally outward from the forward end 22 of the burner wall 20.

Each ejector 25" preferably comprises a fuel ejection tip 36" secured over the end of a fuel supply pipe which is connected to a third fuel supply manifold 34". Although the fuel pipes for the ejector tips 36" are preferably connected to a third fuel supply manifold 34", it will be understood that any other type of fuel supply system could alternatively be used for the ejectors 25".

Although three series 15, 15', and 15" of ejection tips, nozzles, or other fuel gas ejection structures are illustrated in FIG. 1, it will also be understood that four or more series of surrounding ejectors could alternatively be used. Each successive series of fuel ejectors will preferably be spaced radially outward from the previous series of fuel ejectors by at least 0.5 inch, more preferably from about 1.5 to about 7.5 inches, and most preferably from about 2 to about 4.5 inches.

The incorporation of one, two or more additional series 15', 15" of gas fuel ejector tips in the inventive burner apparatus 10 increases the port area available for low Wobbe number fuels. In addition, the larger number of fuel jets increases the rate of mixing of flue gas with the fuel, yielding lower $NO_x$ emissions. Moreover, by sequentially opening additional outer fuel manifolds as the Wobbe number value of the gas fuel decreases, the gas header pressure can be maintained within a range needed for effective jet mixing characteristics. Thus, a wider range of fuels can be fired while achieving robust flame stabilization, good flame shape, and low $NO_x$ emissions.

In addition, as the Wobbe number decreases and each additional outer series of ejectors is activated, proportionally less fuel is fired from the primary injection manifold series 15. Consequently, the equivalence ratio of the gas and air mixture within the primary combustion zone 14 provided by the notch 35 becomes leaner with decreasing Wobbe number. In other words, while a rich, yet flammable mixture is desirably created in the annular exterior notch 35 when firing high Wobbe number fuels, the mixture desirable becomes leaner (i.e., has a lower fuel to air ratio) when firing low Wobbe number fuels. In addition, the burner's overall $NO_x$ emissions are minimized by burning only a small quantity of fuel in the notch region.

In the method of the present invention, the sequential activation or deactivation of additional outer fuel manifolds is preferably automatically controlled by (a) monitoring at least one parameter which is effective for indicating a reduction or increase in the Wobbe number value of the gas fuel and (b) activating or deactivating a secondary series of fuel ejection structures (e.g., a secondary ejector manifold) when the parameter reaches a predetermined value. Consequently, for example, if the inventive burner 10 were operating using only its primary series 15 of ejectors 25, the secondary series 15' of ejectors 25' would be automatically activated if the monitored parameter(s) reached a predetermined value indicating a sufficient decline in the Wobbe number value of the fuel. Subsequently, if the Wobbe number value of the fuel continued to decline such that the monitored parameter(s) again reached a predetermined value, the third series 15" of ejectors 25" would also be automatically activated.

By way of example, but not by way of limitation, the monitored parameter could include or consist of the fuel gas pressure of the inner ejector ring(s) such that an additional outer ring of ejectors might be automatically activated as the maximum available pressure for the inner ring(s) is reached. Alternatively, examples of other parameters which could be monitored and used for control purposes include, but are not limited to, the composition and/or Wobbe number of the fuel.

Each of the fuel gas ejector tips 36, 36', and 36" in the primary, secondary and third series of ejector tips can have any desired number of ejection ports provided therein. Such ports can also be of any desired shape and can be arranged to provide generally any desired pattern or regime of fuel gas flow outside of burner wall 20. Examples of suitable ejection port shapes include but are not limited to circles, ellipses, squares, rectangles, and supersonic-type ejection orifices.

Each of the ejector tips 36, 36', and 36" employed in burner 10 will most preferably have only a single ejection port provided therein. The individual ejection port provided in each ejector tip 36, 36', and 36" can be of any shape capable of providing the free jet flow and degree of entrainment and mixing desired. Additionally, the individual ejection orifices of all of the ejector tips 36, 36', and 36" can be of the same shape or can be of any desired combination of differing acceptable shapes. Typically, the ejection ports of tips 36, 36', and 36" will be, or will have a size equivalent to, a circular port having a diameter in the range of from about 0.062 to about 0.50 inches.

Depending primarily upon the size of the burner and the capacity requirements of the particular application in question, generally any number and spacing of the ejectors 25, 25', and 25" in the primary, secondary, or third series 15, 15', or 15" can be used. The spacing between adjacent pairs of ejectors will typically be the same, but can be different. Adjacent pairs of ejectors 25', 25', or 25' will preferably be spaced a sufficient distance apart such that neighboring ejectors will not interfere with each other in regard to the free jet entrainment of flue gas in the ejected streams. Each adjacent pair of ejectors will typically be spaced at least 0.25 inches (more typically at least 1.5 inches) apart. Each pair of adjacent primary ejectors 25 will more preferably be spaced from about 1.5 inches to about 2.2 inches apart.

Figure 9:
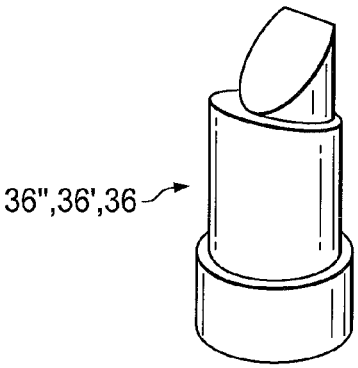
FIG. 9 is a perspective view of a fuel gas ejector tip 36 preferred for use in the burner assembly 10.

Each of the primary, secondary and tertiary fuel ejector tips 36, 36' and 36" used in the inventive burner 10 will preferably be of a type as shown and described in U.S. Pat. No. 6,626,661. U.S. Pat. No. 6,626,661 is incorporated herein by reference in its entirety. A particularly preferred ejector tip structure 36, 36', 36" is shown in FIG. 9.

These tip configurations reduce plugging and coking generally associated with most burner stability problems. They also have less mass and less exposed area which reduces temperature gain and thus reduces coking. In addition, the probability of plugging is further reduced since there is preferably only one port drilled in the tip. Further, the aerodynamic shapes of these tips additionally enhances the mixing of inert gases with the fuel gas ejected from the tips. The "air foil" type shape increases the flow of inert products of combustion around the tip for greater mixing which in turn reduces $NO_x$ emissions.

Further, the preferred use of only one (1) port drilled on the tip contributes to the significantly enhanced turndown ratio provided by the inventive burner assembly 10. In addition, since these tips do not require ignition ports and therefore allow the use of smaller fuel ports, more tips can be evenly positioned around the burner tile, thus enabling the burner to more evenly mix the fuel gas and combustion air together, which allows the burner to operate with lower excess air.

The following example is meant to illustrate, but in no way limit, the claimed invention.

EXAMPLE

Tests were performed using an inventive burner assembly 10 as depict in FIGS. 1-9. The burner assembly 10 had: a design firing rate of 5 MMBTU/Hr; a circular burner wall 20; an outside diameter at the forward end 22 of the burner wall 20 of 18.5 inches; an inside diameter at the discharge end of the burner throat of 11.75 inches; a circular annular exterior combustion notch 35 formed in the burner wall and having a radial depth of 1.75 inches and a longitudinal width of 1.5 inches; a total of 34 tapered primary air delivery channels 40 having an inlet diameter of 0.75 inches at the base end of the burner wall and an outlet end diameter of 0.625 inches at the annular notch 35; a primary ring 15 of ejectors having a total of 34 primary ejector tips 25; two additional outer rings 15' and 15" of surrounding ejector tips; and a total of 17 rectangular primary combustion product discharge slots 41, each having an arc length of 10.59° and a radial width of 0.75 inches. In the annular exterior notch 35, the entrance openings of the combustion product slots 41 were offset radially inward from the discharge openings of the primary air delivery channels 40 by 0.75 inches.

In simulations of the burner assembly 10 performed using Computational Fluid Dynamics Modeling, the burner performed successfully on fuels ranging from syngas having a Wobbe number of only 117 to natural gas having a Wobbe number of 1346.

In actual testing, the inventive burner assembly 10 was vertically-mounted in a single-pass furnace having dimensions of 7 feet long by 5 feet wide by 45 feet tall. The furnace had six single-pass, water-tubes running from the top to the bottom of the heater to remove heat. The tubes were covered with 1 inch-thick ceramic fiber insulation from the floor to six feet above the floor. The remaining portions of the tubes were left bare.

The burner assembly was successfully fired using each of the gas fuels identified in the following Table 1. The gaseous fuels had Wobbe number values ranging from 116.5 to 1339.5. Emission samples were extracted at the base of the furnace stack below the stack damper. The firebox temperature was measured with a velocity thermocouple located about 14 feet above the furnace floor. The floor temperature was measured through the furnace door with a velocity thermocouple located about 1.5 feet above the furnace floor. Furnace draft was measured at the floor of the furnace.

TABLE 1

| | Charcoal % vol | Nat. Gas % vol | Bio Gas % vol | Land Fill % vol | Biomass % vol | Wood % vol |
|---|---|---|---|---|---|---|
| Composition | | | | | | |
| CH4 (methane) | 1.00% | 94.00% | 56.00% | 52.00% | | 3.00% |
| C2H6 (ethane) | | 2.00% | | | | |
| C3H8 (propane) | | 2.00% | | | | |
| CO2 | 2.00% | | 36.00% | 47.00% | 8.00% | 9.00% |
| H2O | | | | | 9.00% | |
| O2 | | | | | | |
| N2 | 65.00% | 2.00% | 8.00% | 1.00% | 45.00% | 50.00% |
| SO2 | | | | | | |
| H2S | | | | | | |
| CO | 28.00% | | | | 20.00% | 20.00% |
| NH3 | | | | | | |
| H2 | 4.00% | | | | 18.00% | 18.00% |
| AR | | | | | | |
| Total (vol %) | 100.00% | 100% | 100% | 100% | 100% | 100% |
| Excess O2 (vol %) | 1.53% | 3.00% | 2.79% | 2.75% | 1.80% | 1.93% |
| TEMP (° F.) | 70 | 70 | 70 | 70 | 70 | 70 |
| LHV (Btu/scf) | 109.9 | 933.1 | 509.0 | 472.7 | 113.5 | 140.8 |
| HHV (Btu/scf) | 112.9 | 1035.1 | 565.6 | 525.2 | 122.5 | 152.8 |
| S.G. | 0.94 | 0.60 | 0.94 | 1.02 | 0.82 | 0.84 |
| M.W. | 27.20 | 17.29 | 27.16 | 29.40 | 23.73 | 24.44 |
| Wobbe Index | 116.5 | 1339.5 | 584.0 | 521.3 | 135.4 | 166.4 |

After sufficient testing had been performed to ensure and confirm proper performance on the above-identified range of fuels, the burner was moved to, and horizontally mounted in, a second furnace for further testing for bio-derived fuels. The second furnace was a single-pass cabin style furnace that was about 37 feet long by 12 feet tall by 6.8 feet wide (inside of the tubes to inside of the tubes). The furnace had two sets of tube banks along the walls of the furnace. The west set (closest to the burner) had nine horizontal, single-pass water tubes (four on the south side and five on the north side) running from about 2 to 25 feet from the burner end of the heater. The tubes were left bare to maximize heat transfer. The east bank consisted of 24 horizontal, single-pass water tubes (12 on each side) running from about 26 to 36 feet from the west end of the heater. These tubes were also left bare to maximize heat transfer.

Flue gas samples for emissions were extracted at the base of the furnace stack below the stack damper. Firebox temperature was measured with a velocity thermocouple located 16 feet from the burner. Stack temperature was measured at the base of the stack below the stack damper. Furnace draft was measured at the wall of the mounted burner.

Test results for the inventive burner assembly 10 operating on natural gas and on the simulated bio-derived fuel are provided in the following Table 2. The bio-fuel represented one of the more challenging compositions with respect to flame stabilization, since the primary reactive species was methane and the level of dilution with carbon dioxide was high.

TABLE 2

| | Natural Gas | Bio-derived |
|---|---|---|
| FUEL GAS | | |
| Natural Gas % | 100.0 | 52.0 |
| Carbon Dioxide % | — | 48.0 |
| FUEL GAS DATA | | |
| Heat Release MMBTU/HR. | 5.000 | 5.000 |
| Inner Manifold Pressure PSIG | 4.6 | 2.6 |

TABLE 2-continued

| | Natural Gas | Bio-derived |
|---|---|---|
| Inner Manifold Temperature F. | 39 | 37 |
| Middle Manifold Pressure PSIG | 0.1 | 4.4 |
| Middle Manifold Temperature F. | 52 | 50 |
| COMBUSTION AIR | | |
| Ambient Air Temperature F. | 42 | 40 |
| Relative Humidity % | 88 | 89 |
| Barometric Pressure IN. Hg. | 30.29 | 30.30 |
| Furnace Draft IN. W.C. | 0.31 | 0.31 |
| Air Door Setting | 3.75 | 4.50 |
| T.V. Air Door Setting (in open) | F/O | F/O |
| EMISSIONS DATA | | |
| Oxygen % (Dry Basis) | 2.9 | 3.1 |
| CO PPMV | 0.0 | 0.0 |
| $NO_x$ PPMV | 19.8 | 9.9 |
| Firebox Temperature F. | 1593 | 1607 |
| Floor Temperature F. | 1470 | 1485 |
| Visible Flame Length Ft. | 8-9 | 8-9 |
| Visible Flame Width Ft. | 3-4 | 3-4 |

For operation with natural gas, essentially all of the fuel was injected through the inner ring 15 of tips 25 of the burner assembly 10. Due to the lower Wobbe number of the bio-fuel, both the inner ring 15 and middle ring 15' of tips were utilized. For each fuel, flames were established within the annual exterior notch 35. Hot products exiting the notch 35 supported stabilization of the main flame on the tile's outer end surface 22.

Air pollutant emission levels when operating with about 15 percent excess air were low for each fuel. The carbon monoxide concentrations were below 1 ppm. The $NO_x$ concentration for operation with natural gas was about 20 ppm. For the simulated bio-gas this level dropped to about 10 ppm.

The visible flame envelopes for these fuels were similar. At the design firing rate of 5 MMBTU/hr, the flame length was about 8.5 ft. and the diameter was about 3.5 ft.

These tests demonstrated that the inventive fuel-flexible burner is able to utilize fuels having more than an order-of-magnitude variation in Wobbe number while maintaining stable flames and generating very low levels of $NO_x$ and CO emissions. Rapid and wide changes in fuel heating value were accommodated without noticeable changes in flame stability.

Thus, the present invention is well adapted to carry out the objectives and attain the ends and advantages mentioned above as well as those inherent therein. Moreover, the invention is not limited in its application to the details of the preferred embodiments and steps described herein. While presently preferred embodiments have been described for purposes of this disclosure, numerous changes and modifications will be apparent to those of ordinary skill in the art. Such changes and modifications are encompassed within this invention as defined by the claims. In addition, the phraseology and terminology employed herein are for the purpose of description and not of limitation.

It will also be understood by those of ordinary skill in the art that, unless otherwise specified, the inventive features, structures, and steps discussed herein can be advantageously employed using any number of exterior fuel ejection nozzles, each having one or any other number of flow ejection ports provided therein. In addition, the inventive burner described herein can be oriented upwardly, downwardly, horizontally, or at generally any other desired operating angle.

What is claimed:

1. A burner apparatus for a fired heating system comprising:

a longitudinally extending burner wall, said burner wall having a forward end, a longitudinally extending exterior, a longitudinally extending air passageway which extends longitudinally through and is surrounded by said burner wall, and a discharge opening of said longitudinally extending air passageway at said forward end of said burner wall;

an exterior notch which is provided in and extends around said longitudinally extending exterior of said burner wall, wherein said exterior notch laterally surrounds said longitudinally extending air passageway, said exterior notch is positioned longitudinally rearward of said forward end of said burner wall, and said exterior notch comprises (i) an interior wall which surrounds said longitudinally extending air passageway and separates said exterior notch from said longitudinally extending air passageway and (ii) an open outer face which surrounds said longitudinally extending air passageway;

a plurality of primary air delivery channels, different from said longitudinally extending air passageway, which are formed in said burner wall and extend to said exterior notch, said primary air delivery channels having outlet openings formed in a longitudinally rearward portion of said interior wall of said exterior notch;

a plurality of fuel ejection structures positioned outside of said open outer face of said exterior notch, wherein said fuel ejection structures have fuel ejection ports and at least some of said fuel ejection ports are oriented for delivering a gas fuel into said exterior notch through said open outer face thereof for combustion in a primary combustion zone, which is at least partially defined within said exterior notch and is isolated from said longitudinally extending air passageway, to produce a primary combustion product gas; and a plurality of primary combustion product gas discharge channels extending longitudinally in said burner wall for discharging at least a portion of said primary combustion product gas which is produce in said exterior notch, wherein said primary combustion product gas discharge channels are different from and isolated from said longitudinally extending air passageway, said primary combustion product gas discharge channels having inlet openings formed in a longitudinally forward portion of said interior wall of said exterior notch, said primary combustion product gas discharge channels extend to outlet openings which are formed in said forward end of said burner wall, and said outlet opening of said primary combustion product gas discharge channels surround and are spaced radially outward from said discharge opening of said longitudinally extending air passageway so that none of said gas fuel ejected from said fuel ejection structures into said exterior notch and none of said primary combustion product gas produced in said primary combustion zone are permitted to flow into said longitudinally extending air passageway.

2. The burner apparatus of claim 1 wherein:

said fuel ejection ports of a first set of said fuel ejection structures are oriented for ejecting said gas fuel outside of said burner wall at a first angle such that at least a portion of said gas fuel ejected therefrom will be delivered into said exterior notch and said fuel ejection ports of a second set of said fuel ejection structures are oriented for ejecting said gas fuel outside of said burner wall at a second angle which is different from said first angle such that said gas fuel ejected therefrom will be delivered to a location which is longitudinally forward of said exterior notch.

3. The burner apparatus of claim 1 wherein said inlet openings of said primary combustion product gas discharge channels in said longitudinally forward portion of said interior wall of said exterior notch are at least partially offset radially inward with respect to said discharge openings of said primary air delivery channels formed in said longitudinally rearward portion of said interior wall of said exterior notch.

4. The burner apparatus of claim 1 wherein said exterior notch is substantially circular and has a substantially rectangular longitudinal cross-sectional shape.

5. The burner apparatus of claim 1 wherein:

said fuel ejection structures form a series of primary fuel ejection structures which substantially surround said burner wall and said burner apparatus further comprises a series of secondary fuel ejection structures which substantially surround said burner wall, said series of said secondary fuel ejection structures being spaced radially outward from said series of said primary fuel ejector structures, each of said secondary fuel ejection structures having a fuel ejection port, and said fuel ejection ports of said secondary fuel ejection structures being positioned longitudinally rearward of and laterally outward from said forward end of said burner wall.

6. A method of operating a burner comprising the steps of:

(a) ejecting a gas fuel from a plurality of ejection structures positioned outside of a longitudinally extending burner wall such that a first portion of said gas fuel is received in an exterior notch which is provided in and extends around a longitudinally extending exterior of said burner wall, said exterior notch being positioned longitudinally rearward of a forward end of said burner wall, said burner wall having a longitudinally extending air passageway which extends longitudinally through and is surrounded by said burner wall, said longitudinally extending air passageway having a discharge opening at said forward end of said burner wall, said exterior notch laterally surrounds said longitudinally extending air passageway, said exterior notch comprises (i) an interior wall which surrounds said longitudinally extending air passageway and separates said exterior notch from said longitudinally extending air passageway, and (ii) an open outer face which surrounds said longitudinally extending air passageway, said ejection structures are positioned outside of said open outer face of said exterior notch, and said ejection structures eject said first portion of said gas fuel into said exterior notch through said open outer face thereof;

(b) delivering a first amount of air into said exterior notch through a plurality of primary air delivery channels, different from said longitudinally extending air passageway, which are formed in said burner wall, said primary air delivery channels having outlet openings formed in a longitudinally rearward portion of said interior wall of said exterior notch;

(c) combusting at least some of said first portion of said gas fuel in said exterior notch to produce a primary combustion product gas;

(d) delivering at least a portion of said primary combustion product gas to said forward end of said burner wall via a plurality of primary combustion product discharge channels which extend longitudinally in said burner wall from said exterior notch to said forward end of said burner wall, wherein said primary combustion product gas discharge channels are different from and isolated from said longitudinally extending air passageway, said primary combustion product gas discharge channels having inlet openings formed in a longitudinally forward portion of said interior wall of said exterior notch, said primary combustion product gas discharge channels extend to outlet openings which are formed in said forward end of said burner wall, and said outlet openings of said primary combustion product gas discharge channels surround and are spaced radially outward from said discharge opening of said longitudinally extending air passageway so that none said first portion of said gas fuel ejected from said ejection structures into said exterior notch and none of said primary combustion product gas are permitted to flow into said longitudinally extending air passageway; and (e) combusting a second portion of said gas fuel forwardly of said exterior notch with air delivered through said longitudinally extending air passageway.

7. The method of claim 6 wherein:

said first portion of said gas fuel is ejected from a first set of said fuel ejection structures having fuel ejection ports which are oriented for ejecting said first portion of said gas fuel outside of said burner wall at a first angle such that said first portion of said gas fuel is delivered into said exterior notch and said second portion of said gas fuel is ejected from a second set of said fuel ejection structures having fuel ejection ports which are oriented for ejecting said second portion of said gas fuel outside of said burner wall at a second angle which is different from said first angle such that said second portion of said gas fuel is combusted forwardly of said exterior notch.

8. The method of claim 6 wherein:

said fuel ejection structures form a series of primary fuel ejection structures which substantially surround said burner wall and said method further comprises the steps of (i) monitoring at least one parameter effective for indicating a reduction in a Wobbe number value of said gas fuel and (ii) beginning ejection of an additional amount of gas fuel from a series of secondary fuel ejection structures substantially surrounding said burner wall when said parameter reaches a predetermined value, said series of said secondary fuel ejection structures being spaced radially outward from said series of said primary fuel ejector structures, said secondary fuel ejection structures having fuel ejection ports, and said fuel ejection ports of said secondary fuel ejection structures being positioned longitudinally rearward of and laterally outward from said forward end of said burner wall.

9. A burner apparatus for a fired heating system comprising:

a longitudinally extending burner wall, said burner wall having a forward end, a longitudinally extending exterior, a longitudinally extending air passageway which extends through and is substantially surrounded by said burner wall, and a discharge opening of said air passageway at said forward end of said burner wall;

an exterior notch which is provided in and extends substantially around said longitudinally extending exterior of said burner wall, wherein said exterior notch is positioned rearwardly of said forward end of said burner wall;

a plurality of primary air delivery channels which are formed in said burner wall and extend to said exterior notch;

a plurality of primary combustion product gas discharge channels which extend in said burner wall from said exterior notch to said forward end of said burner wall;

a plurality of fuel ejection structures positioned outside of said burner wall wherein said fuel ejection structures have fuel ejection ports and at least some of said fuel ejection ports are oriented for delivering at least a portion of a gas fuel into said exterior notch;

said fuel ejection ports of a first set of said fuel ejection structures are oriented for ejecting said gas fuel outside of said burner wall at a first angle such that at least a portion of said gas fuel ejected therefrom will be delivered into said exterior notch;

said fuel ejection ports of a second set of said fuel ejection structures are oriented for ejecting said gas fuel outside of said burner wall at a second angle which is different from said first angle such that said gas fuel ejected therefrom will be delivered to a location which is longitudinally forward of said exterior notch; and said fuel ejection structures of said first set are positioned in an alternating relationship with said fuel ejection structures of said second set in series around said burner wall.

10. A burner apparatus for a fired heating system comprising:

a longitudinally extending burner wall, said burner wall having a forward end, a longitudinally extending exterior, a longitudinally extending air passageway which extends through and is substantially surrounded by said burner wall, and a discharge opening of said air passageway at said forward end of said burner wall;

an exterior notch which is provided in and extends substantially around said longitudinally extending exterior of said burner wall, wherein said exterior notch is positioned rearwardly of said forward end of said burner wall;

a plurality of primary air delivery channels which are formed in said burner wall and extend to said exterior notch;

a plurality of primary combustion product gas discharge channels which extend in said burner wall from said exterior notch to said forward end of said burner wall;

a plurality of fuel ejection structures positioned outside of said burner wall wherein said fuel ejection structures have fuel ejection ports and at least some of said fuel ejection ports are oriented for delivering at least a portion of a gas fuel into said exterior notch; and each of said fuel ejection structures has only one fuel ejection port.

11. A burner apparatus for a fired heating system comprising:

a longitudinally extending burner wall, said burner wall having a forward end, a longitudinally extending exterior, a longitudinally extending air passageway which extends through and is substantially surrounded by said burner wall, and a discharge opening of said air passageway at said forward end of said burner wall;

an exterior notch which is provided in and extends substantially around said longitudinally extending exterior of said burner wall, wherein said exterior notch is positioned rearwardly of said forward end of said burner wall;

a plurality of primary air delivery channels which are formed in said burner wall and extend to said exterior notch;

a plurality of primary combustion product gas discharge channels which extend in said burner wall from said exterior notch to said forward end of said burner wall;

a plurality of fuel ejection structures positioned outside of said burner wall wherein said fuel ejection structures have fuel ejection ports and at least some of said fuel ejection ports are oriented for delivering at least a portion of a gas fuel into said exterior notch;

said primary air delivery channels have discharge openings which are positioned in a series in said exterior notch;

said primary combustion product gas discharge channels have inlet openings which are positioned in a series in said exterior notch;

said series of said inlet openings of said primary combustion product gas discharge channels is positioned longitudinally forward of and radially inward from said series of said discharge openings of said primary air delivery channels;

said burner wall comprises a first longitudinally extending tile piece having a distal end;

said burner wall further comprises a forward tile piece which is attached to said distal end of said first tile piece and which defines said forward end of said burner wall;

said primary air delivery channels extend longitudinally through said first tile piece to said exterior notch; and said primary combustion product gas discharge channels extend through said forward tile piece from said exterior notch to said forward end of said burner wall.

12. A burner apparatus for a fired heating system comprising:

a longitudinally extending burner wall, said burner wall having a forward end, a longitudinally extending exterior, a longitudinally extending air passageway which extends through and is substantially surrounded by said burner wall, and a discharge opening of said air passageway at said forward end of said burner wall;

an exterior notch which is provided in and extends substantially around said longitudinally extending exterior of said burner wall, wherein said exterior notch is positioned rearwardly of said forward end of said burner wall;

a plurality of primary air delivery channels which are formed in said burner wall and extend to said exterior notch;

a plurality of primary combustion product gas discharge channels which extend in said burner wall from said exterior notch to said forward end of said burner wall;

a plurality of fuel ejection structures positioned outside of said burner wall wherein said fuel ejection structures have fuel ejection ports and at least some of said fuel ejection ports are oriented for delivering at least a portion of a gas fuel into said exterior notch;

said primary air delivery channels have discharge openings which are positioned in a series in said exterior notch;

said primary combustion product gas discharge channels have inlet openings which are positioned in a series in said exterior notch;

said series of said inlet openings of said primary combustion product gas discharge channels is positioned longitudinally forward of and radially inward from said series of said discharge openings of said primary air delivery channels; and said burner wall has a substantially circular cross-sectional shape.

13. A burner apparatus for a fired heating system comprising:

a longitudinally extending burner wall, said burner wall having a forward end, a longitudinally extending exterior, a longitudinally extending air passageway which extends through and is substantially surrounded by said burner wall, and a discharge opening of said air passageway at said forward end of said burner wall;

an exterior notch which is provided in and extends substantially around said longitudinally extending exterior of said burner wall, wherein said exterior notch is positioned rearwardly of said forward end of said burner wall;

a plurality of primary air delivery channels which are formed in said burner wall and extend to said exterior notch;

a plurality of primary combustion product gas discharge channels which extend in said burner wall from said exterior notch to said forward end of said burner wall;

a plurality of fuel ejection structures positioned outside of said burner wall wherein said fuel ejection structures have fuel ejection ports and at least some of said fuel ejection ports are oriented for delivering at least a portion of a gas fuel into said exterior notch;

said fuel ejection structures form a series of primary fuel ejection structures which substantially surround said burner wall;

said burner apparatus further comprises a series of secondary fuel ejection structures which substantially surround said burner wall, said series of said secondary fuel ejection structures being spaced radially outward from said series of said primary fuel ejector structures, each of said secondary fuel ejection structures having a fuel ejection port, and said fuel ejection ports of said secondary fuel ejection structures being positioned longitudinally rearward of and laterally outward from said forward end of said burner wall; and said secondary fuel ejection structures have fuel ejection ports which are oriented for ejecting said gas fuel such that at least most of said gas fuel ejected therefrom is delivered to a location which is at least as far longitudinally forward as an outer edge of said forward end of said burner wall.

14. A burner apparatus for a fired heating system comprising:

a longitudinally extending burner wall, said burner wall having a forward end, a longitudinally extending exterior, a longitudinally extending air passageway which extends through and is substantially surrounded by said burner wall, and a discharge opening of said air passageway at said forward end of said burner wall;

an exterior notch which is provided in and extends substantially around said longitudinally extending exterior of said burner wall, wherein said exterior notch is positioned rearwardly of said forward end of said burner wall;

a plurality of primary air delivery channels which are formed in said burner wall and extend to said exterior notch;

a plurality of primary combustion product gas discharge channels which extend in said burner wall from said exterior notch to said forward end of said burner wall;

a plurality of fuel ejection structures positioned outside of said burner wall wherein said fuel ejection structures have fuel ejection ports and at least some of said fuel ejection ports are oriented for delivering at least a portion of a gas fuel into said exterior notch;

said fuel ejection structures form a series of primary fuel ejection structures which substantially surround said burner wall;

said burner apparatus further comprises a series of secondary fuel ejection structures which substantially surround said burner wall, said series of said secondary fuel ejection structures being spaced radially outward from said series of said primary fuel ejector structures, each of said secondary fuel ejection structures having a fuel ejection port, and said fuel ejection ports of said secondary fuel ejection structures being positioned longitudinally rearward of and laterally outward from said forward end of said burner wall; and said burner apparatus further comprises a third series of fuel ejection structures which substantially surround said burner wall, said third series of fuel ejection structures being spaced radially outward from said series of said secondary fuel ejector structures, and said third series of fuel ejection structures having fuel ejection ports which are positioned longitudinally rearward of and laterally outward from said forward end of said burner wall.

15. A method of operating a burner comprising the steps of:

(a) ejecting a gas fuel from a plurality of ejection structures positioned outside of a longitudinally extending burner wall such that a first portion of said gas fuel is received in an exterior notch which is provided in and extends around a longitudinally extending exterior of said burner wall, said exterior notch being positioned rearwardly of a forward end of said burner wall;

(b) delivering a first amount of air into said exterior notch and combusting at least some of said first portion of said gas fuel in said exterior notch to produce a primary combustion product gas;

(c) delivering at least a portion of said primary combustion product gas to said forward end of said burner wall via a plurality of primary combustion product discharge channels which extend in said burner wall from said exterior notch to said forward end of said burner wall; and (d) combusting a second portion of said gas fuel forwardly of said exterior notch with air delivered through an air passageway which extends longitudinally through and is surrounded by said burner wall, said first amount of air being delivered to said exterior notch via a plurality of primary air delivery channels which extend longitudinally in said burner wall to said exterior notch;

said primary air delivery channels having discharge openings which are positioned in a series in said exterior notch;

said primary combustion product gas discharge channels having inlet openings which are positioned in a series in said exterior notch; and said series of said inlet openings of said primary combustion product gas discharge channels being positioned longitudinally forward of and radially inward from said series of said discharge openings of said primary air delivery channels.

16. A method of operating a burner comprising the steps of:

(a) ejecting a gas fuel from a plurality of ejection structures positioned outside of a longitudinally extending burner wall such that a first portion of said gas fuel is received in an exterior notch which is provided in and extends around a longitudinally extending exterior of said burner wall, said exterior notch being positioned rearwardly of a forward end of said burner wall;

(b) delivering a first amount of air into said exterior notch and combusting at least some of said first portion of said gas fuel in said exterior notch to produce a primary combustion product gas;

(c) delivering at least a portion of said primary combustion product gas to said forward end of said burner wall via a plurality of primary combustion product discharge channels which extend in said burner wall from said exterior notch to said forward end of said burner wall; and (d) combusting a second portion of said gas fuel forwardly of said exterior notch with air delivered through an air passageway which extends longitudinally through and is surrounded by said burner wall, said first portion of said gas fuel being ejected from a first set of said fuel ejection structures having fuel ejection ports which are oriented for ejecting said first portion of said gas fuel outside of said burner wall at a first angle such that said first portion of said gas fuel is delivered into said exterior notch, said second portion of said gas fuel being ejected from a second set of said fuel ejection structures having fuel ejection ports which are oriented for ejecting said second portion of said gas fuel outside of said burner wall at a second angle which is different from said first angle such that said second portion of said gas fuel is combusted forwardly of said exterior notch, and said fuel ejection structures of said first set being positioned in an alternating relationship with said fuel ejection structures of said second set in a series around said burner wall.

17. A method of operating a burner comprising the steps of:

(a) ejecting a gas fuel from a plurality of ejection structures positioned outside of a longitudinally extending burner wall such that a first portion of said gas fuel is received in an exterior notch which is provided in and extends around a longitudinally extending exterior of said burner wall, said exterior notch being positioned rearwardly of a forward end of said burner wall;

(b) delivering a first amount of air into said exterior notch and combusting at least some of said first portion of said gas fuel in said exterior notch to produce a primary combustion product gas;

(c) delivering at least a portion of said primary combustion product gas to said forward end of said burner wall via a plurality of primary combustion product discharge channels which extend in said burner wall from said exterior notch to said forward end of said burner wall; and (d) combusting a second portion of said gas fuel forwardly of said exterior notch with air delivered through an air passageway which extends longitudinally through and is surrounded by said burner wall, said fuel ejection structures forming a series of primary fuel ejection structures which substantially surround said burner wall, said method further comprises the steps of (i) monitoring at least one parameter effective for indicating a reduction in a Wobbe number value of said gas fuel and (ii) beginning ejection of an additional amount of gas fuel from a series of secondary fuel ejection structures substantially surrounding said burner wall when said parameter reaches a predetermined value, said series of said secondary fuel ejection structures being spaced radially outward from said series of said primary fuel ejector structures, said secondary fuel ejection structures having fuel ejection ports, and said fuel ejection ports of said secondary fuel ejection structures being positioned longitudinally rearward of and laterally outward from said forward end of said burner wall, and said fuel ejection ports of said secondary fuel ejection structures being oriented such that said additional amount of gas fuel is delivered and combusted at a location which is at least as far longitudinally forward as an outer edge of said forward end of said burner wall.

18. The method of claim 17 wherein said method further comprises the step, when said secondary fuel ejection structures are ejecting said additional amount of gas fuel in accordance with step (ii), of beginning ejection of a further amount of gas fuel from a third series of fuel ejection structures substantially surrounding said burner wall when said parameter reaches a predetermined value, said third series of fuel ejection structures being spaced radially outward from said series of said secondary fuel ejector structures, and said third series of fuel ejection structures having fuel ejection ports which are positioned longitudinally rearward of and laterally outward from said forward end of said burner wall.

19. A method of operating a burner comprising the steps of:

(a) ejecting a gas fuel from a plurality of ejection structures positioned outside of a longitudinally extending burner wall such that a first portion of said gas fuel is received in an exterior notch which is provided in and extends around a longitudinally extending exterior of said burner wall, said exterior notch being positioned rearwardly of a forward end of said burner wall;

(b) delivering a first amount of air into said exterior notch and combusting at least some of said first portion of said gas fuel in said exterior notch to produce a primary combustion product gas;

(c) delivering at least a portion of said primary combustion product gas to said forward end of said burner wall via a plurality of primary combustion product discharge channels which extend in said burner wall from said exterior notch to said forward end of said burner wall; and (d) combusting a second portion of said gas fuel forwardly of said exterior notch with air delivered through an air passageway which extends longitudinally through and is surrounded by said burner wall, said fuel ejection structures forming a series of primary fuel ejection structures which substantially surround said burner wall, said method further comprises the steps of (i) monitoring at least one parameter effective for indicating a reduction in a Wobbe number value of said gas fuel and (ii) beginning ejection of an additional amount of gas fuel from a series of secondary fuel ejection structures substantially surrounding said burner wall when said parameter reaches a predetermined value, said series of said secondary fuel ejection structures being spaced radially outward from said series of said primary fuel ejector structures, said secondary fuel ejection structures having fuel ejection ports, and said fuel ejection ports of said secondary fuel ejection structures being positioned longitudinally rearward of and laterally outward from said forward end of said burner wall, and said parameter is a pressure of said gas fuel.

* * * * *